United States Patent [19]

Takeuchi et al.

[11] Patent Number: 4,508,078

[45] Date of Patent: Apr. 2, 1985

[54] ELECTRICALLY OPERATED ENGINE THROTTLE VALVE ACTUATING DEVICE

[75] Inventors: Nobuo Takeuchi; Tadashi Kaneko; Tadataka Nakazumi; Katsuhiko Yokooku, all of Hiroshima, Japan

[73] Assignee: Mazda Motor Corporation, Hiroshima, Japan

[21] Appl. No.: 511,983

[22] Filed: Jul. 8, 1983

[30] Foreign Application Priority Data

Jul. 9, 1982 [JP] Japan ..... 57-120391

[51] Int. Cl.[3] ..... F02D 9/00

[52] U.S. Cl. ..... 123/399; 123/403

[58] Field of Search ..... 123/399, 403, 361, 492, 123/395

[56] References Cited

U.S. PATENT DOCUMENTS

| | | | |
|---|---|---|---|
| 4,169,437 | 10/1979 | Fleischer | 123/361 |
| 4,184,461 | 1/1980 | Ceung | 123/492 |
| 4,305,359 | 12/1981 | Mann et al. | 123/361 |
| 4,430,975 | 2/1984 | Ishida et al. | 123/399 |

FOREIGN PATENT DOCUMENTS 51-138235 11/1976 Japan .

57-91345 6/1982 Japan .

*Primary Examiner*—William A. Cuchlinski, Jr.

*Attorney, Agent, or Firm*—Fleit, Jacobson, Cohn & Price

[57] ABSTRACT

An engine throttle valve operating device comprising a throttle valve operating foot pedal position detector for detecting the position of the foot pedal and producing a foot pedal position signal corresponding to the position of the foot pedal, a rapid acceleration detector connected with the foot pedal position detection for receiving the foot pedal position signal therefrom and producing a rate signal corresponding to a rate of change per unit time of the position of the foot pedal, a throttle valve actuator for actuating the engine throttle valve, a throttle valve driving signal generating circuit responsive to the foot pedal position signal and the rate signal to produce a first drive signal for operating the actuator in accordance with the foot pedal position signal when the rate of change per unit time of the position of the foot pedal is smaller than a predetermined value and a second drive signal for operating the actuator by a greater extent than under the first drive signal when the rate of change per unit time of the position of the operating member is greater than the predetermined value.

5 Claims, 9 Drawing Figures

ELECTRICALLY OPERATED ENGINE THROTTLE VALVE ACTUATING DEVICE

BACKGROUND OF THE INVENTION

The present invention relates to a control of an internal combustion engine and more particularly to throttle valve control means.

In conventional automobile engines, throttle valves are actuated by means of foot pedals which are connected with the throttle valves through linkages or cable mechanisms so that movements of the foot pedals are transmitted to the throttle valves. It should however be noted that the conventional structures are disadvantageous in that where the linkages are adopted the mechanisms become very complicated and there required many connections which inherently have plays so that the movements of the foot pedals cannot be rapidly transmitted to the throttle valve. Where the cable mechanisms are adopted, the cables must be maintained under tension to prevent slackening of the cables, and due to the cable tension and friction developed in the mechanisms, substantial efforts are required for operating the throttle valves.

In order to eliminate the above problems, there has been proposed throttle valves operated by electric actuators. For example, the Japanese patent application No. 50-62408 filed on May 23, 1975 and disclosed for public inspection on Nov. 29, 1976 under the Disclosure No. 51-138235 discloses an engine throttle valve control means including an operating member position detector for detecting the position of a throttle valve operating member such as a foot pedal, a throttle valve position detector for detecting the actual position of throttle valve and a control circuit which receives electric signals from the operating member position detector and the throttle valve position detector to produce an output which is used to operate a reversible actuator for actuating the throttle valve in accordance with the position of the throttle valve operating member. In the mechanism proposed by the Japanese patent application, however, the throttle valve actuator is always operating substantially at a predetermined rate so that the throttle valve cannot be opened with a satisfactory responsive rate even when the operating member is moved very quickly to an open position for rapid acceleration.

OBJECT AND SUMMARY OF THE INVENTION

It is therefore an object of the present invention to provide engine throttle valve operating means in which the throttle valve is operated by an electric actuator in accordance with the position of a throttle valve operating member at a rate which is increased under a rapid acceleration.

Another object of the present invention is to provide an electrically operated engine throttle valve actuating mechanism in which the throttle valve is opened under an increased rate for a rapid acceleration than for a normal operation.

According to the present invention, the above and other objects can be accomplished by engine throttle valve operating means comprising first detecting means for detecting position of an engine throttle valve operating member and producing a first position signal corresponding to the position of the operating member, rate detecting means connected with said first detecting means for receiving said first position signal therefrom and producing a rate signal corresponding to a rate of change per unit time of the position of the operating member, throttle valve actuating means for actuating engine throttle valve means, throttle valve driving signal generating means responsive to said first position signal and said rate signal to produce a first drive signal for operating the actuating means in accordance with said first position signal when the rate of change per unit time of the position of the operating member is smaller than a predetermined value and a second drive signal for operating the actuating means by a greater extent than under said first drive signal when the rate of change per unit time of the position of the operating member is greater than the predetermined value. With the arrangement set forth above, as far as the second driving signal exists, the throttle valve means is opened rapidly to a position a certain extent beyond the position corresponding to the position of the throttle valve operating member. When the movement of the throttle valve operating member is slowed down or the member is stopped, the throttle valve driving signal generating means produces the first driving signal instead of the second driving signal so that the throttle valve means is moved to the position corresponding to the position of the throttle valve operating member. Thus, the throttle valve means is wide open for a rapid acceleration, it is possible to avoid hesitation of engine under acceleration.

BRIEF DESCRIPTION OF THE DRAWINGS

The above and other objects and features of the present invention will become apparent from the following descriptions of preferred embodiments taking reference to the accompanying drawings, in which.

DETAILED DESCRIPTION OF A PREFERRED EMBODIMENT

Figure 1:
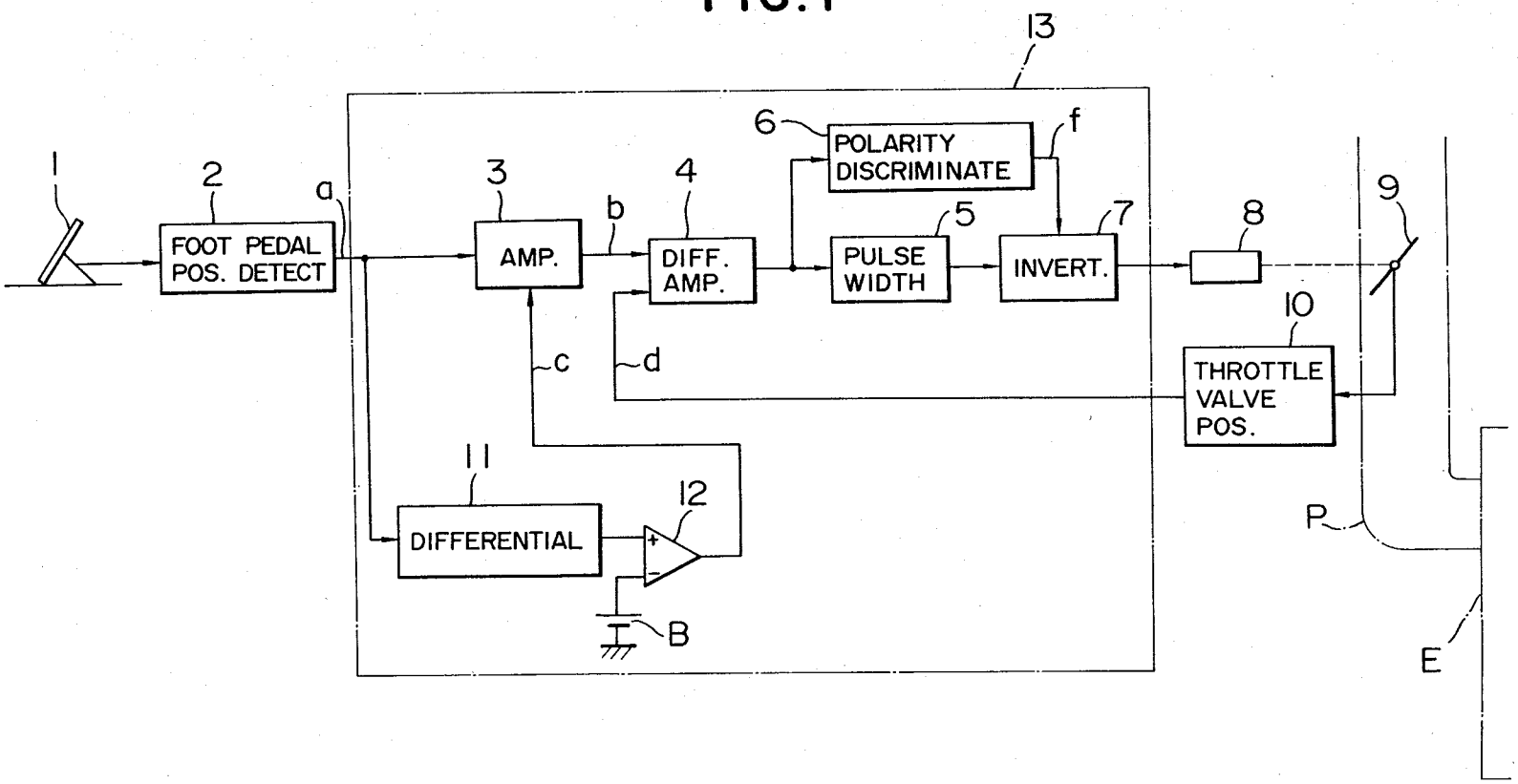
FIG. 1 is a diagrammatical illustration of an engine throttle valve control device in accordance with one embodiment of the present invention.

Referring to the drawings, particularly to FIG. 1, there is diagrammatically shown an engine E having an intake passage P provided with a throttle valve 9. There is also shown a throttle valve operating foot pedal 1 which is provided on an automobile having the engine E mounted thereon. The foot pedal 1 is provided with a pedal position detector 2 which is adapted to detect the position of the foot pedal 1 and produce a pedal position signal a. The output of the position detector 2 is connected on one hand with an amplifier 3 and on the other hand with a differentiating circuit 11. The amplifier 3 functions to amplify the signal a from the detector 2 and produces an output b which is applied to a differential amplifier 4.

The throttle valve 9 is provided with a throttle position detector 10 which is adapted to detect the position of the throttle valve 9 and produce a throttle position signal d. The signal d from the detector 10 is applied to the differential amplifier 4 which compares the signal b from the amplifier 3 with the signal d from the detector 10 to produce an output corresponding to the difference between the two signals. The output of the differential amplifier 4 is applied to a pulse generator 5 which produces a pulse output of which pulse width is determined in accordance with the output of the differential amplifier 4. The output of the pulse generator 5 is applied through an inverting circuit 7 to an actuator 8 which may be a reversible D.C. motor connected with the throttle valve 9.

The output of the differential amplifier 4 is also connected with a discriminating circuit 6 which judges the polarity of the output from the differential amplifier 4 and produces a polarity signal f when a negative signal is received from the differential amplifier 4. The signal f from the discriminating circuit 6 is applied to the inverting circuit 7 so that the circuit 7 inverts the output from the pulse generator 5 when the signal f is received from the discriminating circuit 6.

The differentiating circuit 11 receives the pedal position signal a from the detector 2 and produces a signal corresponding to a rate of change of the pedal position. The output of the differentiating circuit 11 is applied to a positive input of a comparator 12 which has a negative input which is applied with a reference voltage from a battery B. The comparator 12 functions to compare the signal from the differentiating circuit 11 with the reference voltage and produces an rapid acceleration signal C when the signal from the circuit 11 is greater than the reference voltage. The acceleration signal C is then applied to the amplifier 3 to increase the amplification factor thereof.

Figure 2:
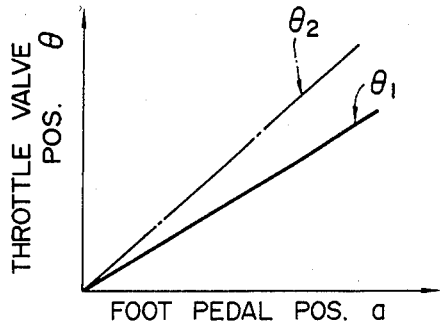
FIG. 2 is a diagram showing the relationship between the position of the throttle valve operating foot pedal and the position of the throttle valve.

In operation, the position of the foot pedal 1 is detected by the detector 2 and the pedal position signal a is applied to the amplifier 3. When the signal from the differentiating circuit 11 is smaller than the reference voltage $E_1$ from the battery B, the comparator 12 does not produce the rapid acceleration signal C. Therefore, the amplifier 3 amplifies the signal a with a smaller amplification factor $K_1$ to produce the signal b. The signal b from the amplifier 3 is compared in the differential amplifier 4 with the throttle valve position signal d from the detector 10 and an output is produced when there is any difference between the signals b and d. For example, when the foot pedal 1 is slowly moved to the throttle valve open position, a positive output signal is applied from the differential amplifier 4 to the pulse generator 5. At this instance, the discriminating circuit 6 does not produce the signal f. Thus, the output pulses from the generator 5 is passed to the actuator 8 to operate the same so that the throttle valve 9 is opened until the throttle position signal d becomes equal to the signal b from the amplifier 3. When the foot pedal 1 is moved toward the closing direction, the circuit 6 produces the signal 5 so that the output from the generator 5 is inverted by the circuit 7 and the actuator 8 is operated in the reverse direction to move the throttle valve 9 toward the closing direction. Thus, the throttle valve position is determined in accordance with the foot pedal position as shown by the line $\theta_1$ in FIG. 2.

When the foot pedal 1 is quickly depressed for rapid acceleration, the output from the differentiating circuit 11 is increased beyond the reference voltage applied to the comparator 12. Thus, the rapid acceleration signal c is produced by the comparator 12. The amplifier 3 receives this signal c and starts to function to amplify the signal a with a larger amplification factor $k_2$. Therefore, the output b is increased and the extent of the throttle valve opening is increased as compared with the operation under a slower foot pedal actuation. The throttle valve position is determined in this instance in accordance with the foot pedal position along the line $\theta_2$ in FIG. 2. As soon as the movement of the foot pedal 1 is stopped or slow down, the signal c from the comparator 12 disappears so that the amplification factor of the amplifier 3 is decreased to the smaller value $k_1$. Then, the position of the throttle valve 9 is thereafter determined in accordance with the line $\theta_1$ in FIG. 2.

Figure 3:
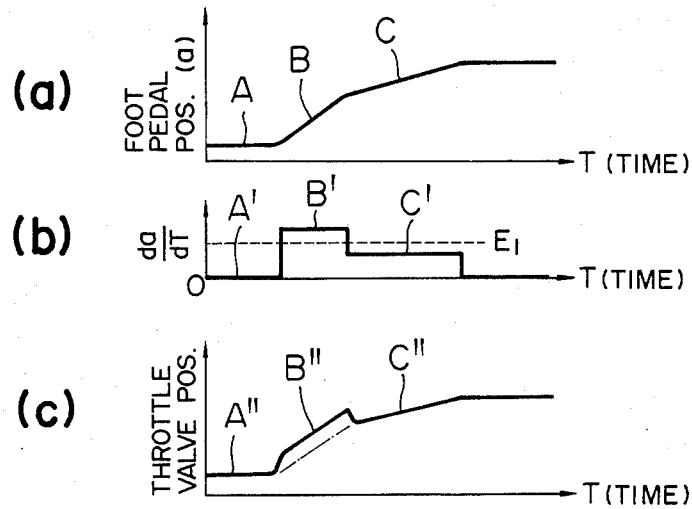
FIGS. 3(*a*), (*b*) and (*c*) show the operation of the control device shown in FIG. 1.

The operation will further be described taking reference to FIG. 3. Assuming that the foot pedal 1 is maintained stationary as shown by A in FIG. 3(*a*), output is not produced by the differentiating circuit as shown by A' in FIG. 3(*b*). The throttle valve 9 is then maintained at the same position as shown by A" in FIG. 3(*c*). When the foot pedal 1 is quickly depressed as shown by B in FIG. 3(*a*), the differentiating circuit 11 produces an output which is greater than the reference voltage $E_1$ as shown by B' in FIG. 3(*b*) so that the amplification factor of the amplifier 3 is increased to the larger value $K_2$. Thus, the throttle valve 9 is opened along the line B" shown in FIG. 3(*c*). It will be noted that the opening of the throttle valve 8 in this instance is greater than that when the throttle valve 9 is controlled under the signal from the amplifier 3 operating with the smaller amplification factor $k_1$.

When the movement of the throttle valve 9 is slow down as shown by C in FIG. 3(*a*), the output from the differentiating circuit 11 is decreased to a valve smaller than the reference voltage $E_1$ as shown by c' in FIG. 3(*b*). Therefore, the amplifier 3 starts to operate with the smaller amplification factor $k_1$ and the throttle valve 9 is opened as shown by c" in FIG. 3(*c*). In the illustrated embodiment, the amplifier 3 is operated always with the smaller amplification factor $k_1$ when the foot pedal 1 is moved in the throttle closing direction.

Figure 4:
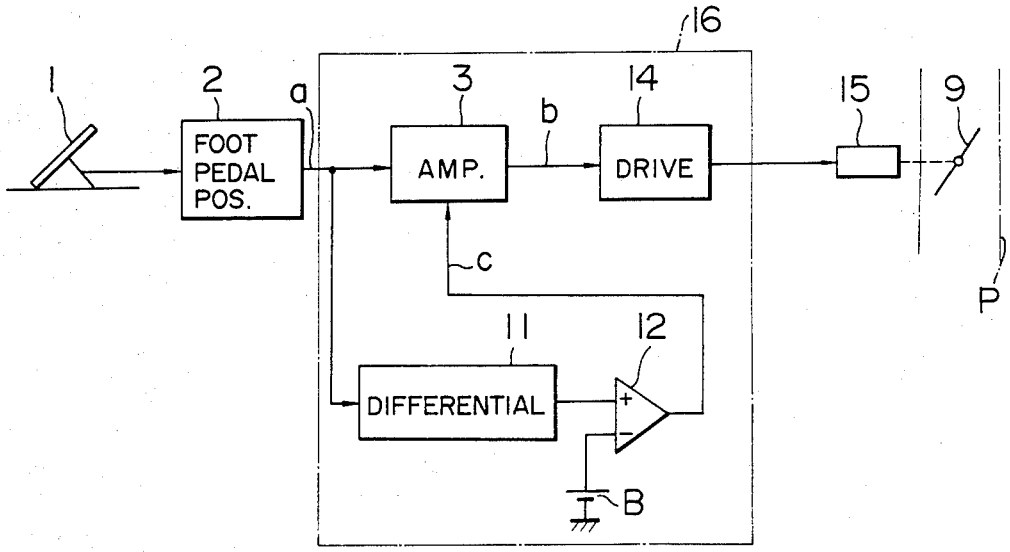
FIG. 4 is a diagrammatical illustration showing another embodiment of the present invention.

Referring now to FIG. 4, the embodiment shown therein has a duty factor type solenoid actuator 15 for operating the throttle valve 9. The output b of the amplifier 3 is connected with a driving circuit 14 which produces output pulses for energizing the actuator 15. The output of the driving circuit 14 is proportional to the level of the output b of the amplifier 3 so that the operating stroke of the actuator 15 and therefore the position of the throttle valve 9 are determined in accordance with the output b of the amplifier 3. In other respects, the arrangements are the same as in the previous embodiment so that corresponding parts are designated by the same reference characters as in FIG. 1.

Figure 5:
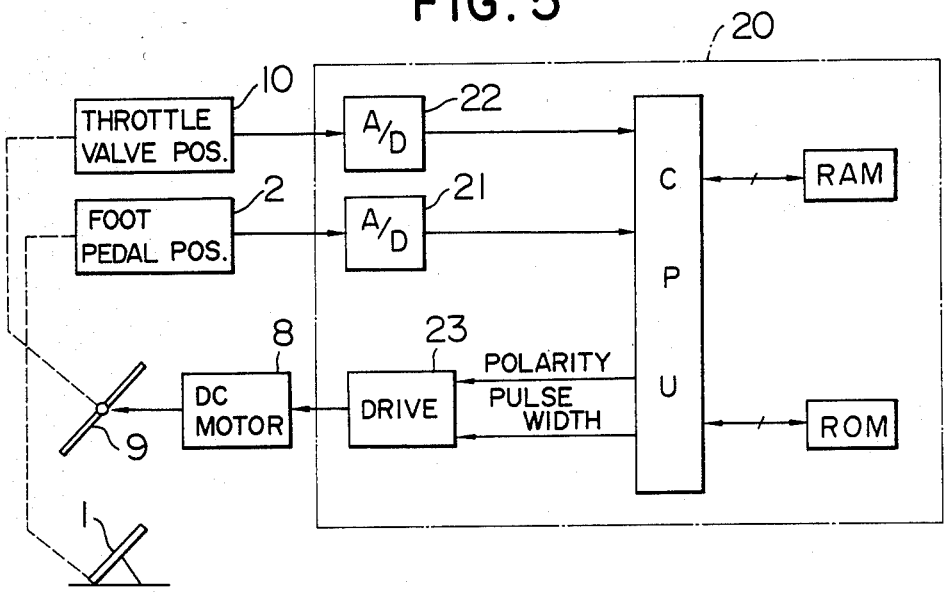
FIG. 5 shows a control circuit diagram of a further embodiment.

In the arrangement shown in FIG. 5, the throttle valve operating foot pedal 1 is provided with a foot pedal position detector 2 and the engine throttle valve 9 with a throttle position detector 10 as in the embodiment shown in FIG. 1. For operating the throttle valve 9, a DC motor 8 is provided. The outputs of the detectors 2 and 10 are connected with a control circuit 20 which may be a microprocessor. The control circuit 20 includes analog-digital converters 21 and 22 which are respectively connected with the outputs of the detectors 2 and 10 so as to convert the analog signals from the detectors 2 and 10 into digital signals. The signals from the A/D converters 21 and 22 are applied to a central power unit CPU which performs operations in accordance with the signals from the A/D converters 21 and 22 and memories from RAM and ROM to produce signals representing polarity and pulse width of the motor operating current. The signals from the unit CPU are applied to a driving circuit 23 to produce motor operating pulses which are applied to the DC motor 8.

Figure 6:
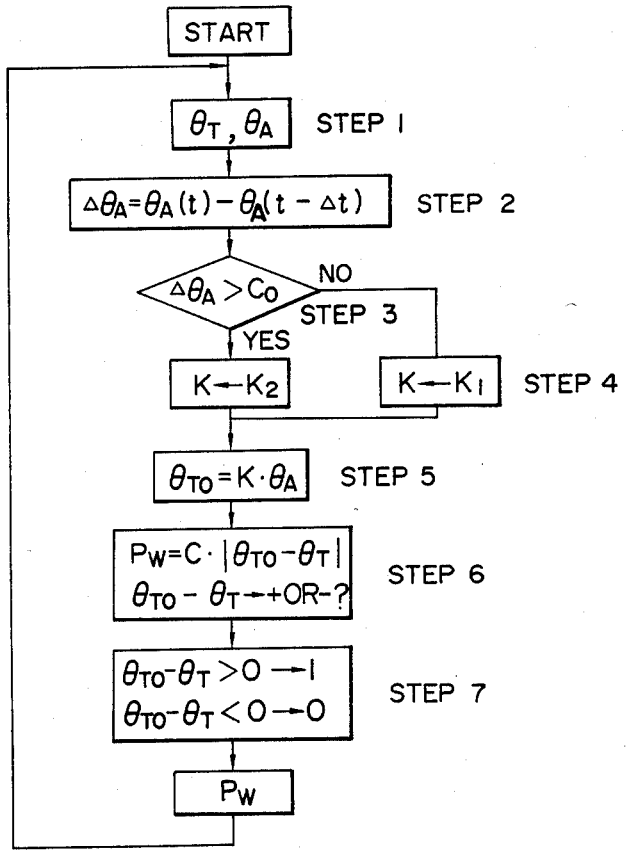
FIG. 6 is a time flow chart showing the operation of the circuit shown in FIG. 5.

FIG. 6 is a flow chart showing the function performed by the central power unit CPU. In the first step, the foot pedal position signal $\theta_A$ and the throttle valve position signal $\theta_T$ are introduced respectively from the A/D converters 21 and 22, and a calculation is made to obtain a value $\Delta\theta_A$ of actuation in a time $\Delta t$ of the foot pedal in the second step. Then, the value $\Delta\theta_A$ is compared with a predetermined value $C_0$ and, if the value $\Delta\theta_A$ is greater than the value $C_0$, a larger value $k_2$ is selected whereas, if the value $\Delta\theta_A$ is smaller than the value $C_0$, a smaller value $k_1$ is selected for the gain K. Thereafter, a desired throttle valve position $\theta_{T0}$ is calculated in the step 5 from the values $\theta_A$ and k, and the pulse width PW and the polarity is determined in the step 6. When the value $\theta_{T0}-\theta_T$ is positive, an output of high level is produced to operate the driving circuit 23 so that output pulses are applied to the motor 8 to rotate the same in the direction wherein the throttle valve 9 is driven toward the open position. When the value $\theta_{T0}-\theta_T$ is negative, a low level output is produced so that the motor 8 is rotated in the opposite direction to close the throttle valve 9.

Figure 7:
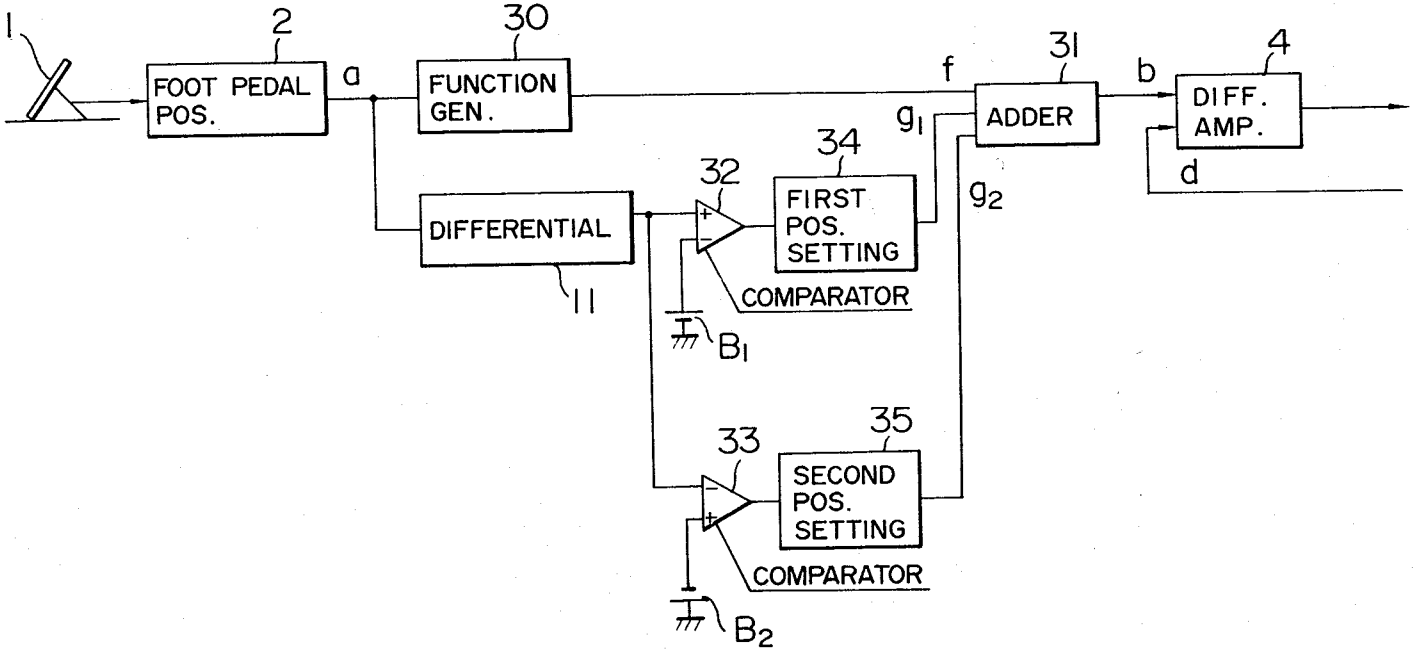
FIG. 7 is a circuit diagram showing a further embodiment of the present invention.

Referring to FIG. 7, there is shown a further embodiment in which the output a from the pedal position detector 2 is applied to a function generator 30. The function generator 30 produces an output f corresponding to the signal a from the position detector 2 and the output of the function generator 30 is applied to an adding circuit 31. The signal a from the pedal position detector 2 is also applied to a differentiating circuit 11 as in the embodiment shown in FIG. 1. The output of the circuit 11 is then applied on one hand to a first comparator 32 and on the other hand to a second comparator 33. The first comparator 32 functions to compare the signal from the circuit 11 with a reference voltage $B_1$ and produce a high level output when the signal from the circuit 11 is greater than the reference voltage $B_1$. The output of the first comparator 32 is applied to a first voltage generator 34 which then produces an output $g_1$ when the high level signal is received from the first comparator 32. The adding circuit 31 functions to add the signals f and $g_1$ and produce an output b which is applied to a differential amplifier 4. The differential amplifier 4 is arranged as in the embodiment of FIG. 1 so that detailed descriptions will not be made further. It will be understood that in this embodiment the throttle valve is actuated by a greater extent when the rate of movement of the foot pedal 1 in the throttle opening direction is greater than a predetermined value as in the embodiment of FIG. 1.

The second comparator 33 functions in deceleration. The comparator 33 compares the signal from the circuit 11 with a negative reference voltage $B_2$ and produces a high level output when the signal from the circuit 33 is lower than the reference voltage $B_2$. The output of the second comparator 33 is applied to a second voltage generator 35 which produces a negative voltage $g_2$ when the high level signal is received from the second comparator 33. The negative voltage $g_2$ is applied to the adding circuit 31 to be added to the signal f. It will therefore be understood that in this embodiment the throttle valve is moved by a greater extent toward the closing direction under a rapid deceleration.

The invention has thus been shown and described with reference to specific embodiment, however, it should be noted that the invention is in no way limited to the details of the illustrated arrangements but changes and modifications may be made without departing from the scope of the appended claims.

We claim:

1. Engine throttle valve operating means comprising:

a first detecting means for detecting the position of an engine throttle valve operating member and producing a first position signal corresponding to the position of the operation member;

a rate detecting means connected with said first detecting means for receiving said first position signal therefrom and producing a rate signal corresponding to a rate of change per unit time of the position of the operation member;

a throttle valve actuating means for actuating the engine throttle valve means;

a throttle valve driving signal generating means responsive to said first position signal and said rate signal to produce a first drive signal for operating the actuating means in accordance with said first position signal when the rate of change per unit time of the position of the operating member is smaller than a predetermined value and generating a second drive signal for operating the actuating means in accordance with said first position signal by a greater extent than under said first drive signal when the rate of change per unit time of the position of the operating member is greater than the predetermined value.

2. Engine throttle valve operating means in accordance with claim 1 in which said throttle valve driving signal generating means includes rapid actuation detecting means connected with said rate detecting means to receive the rate signal therefrom and compare the rate signal with a predetermined value to produce a rapid actuation signal when the rate signal is greater than the predetermined value.

3. Engine throttle valve operating means in accordance with claim 2 in which said throttle valve driving signal further includes throttle valve position setting means connected with said first detecting means and said rapid acceleration detecting means for receiving the first position signal and the rapid actuation signal therefrom and producing said first and second drive signal.

4. Engine throttle valve operating means in accordance with claim 2 in which said throttle valve driving signal generating means further includes throttle valve position setting means comprising throttle valve position setting means connected with said first detecting means for receiving the first position signal therefrom to produce said first drive signal and modifying means connected with said rate detecting means for producing a modifying signal which is applied to said throttle valve position setting means to modify the first drive signal and produce said second drive signal.

5. Engine throttle valve operating means in accordance with claim 1 which further includes second detecting means for detecting position of engine throttle valve means and producing a second position signal corresponding to the position of the throttle valve means, said throttle valve driving signal generating means including comparing means for comparing said first with second position signals and producing one of said first and second drive signals when there is a difference between said first and second position signals.

* * * * *